United States Patent [19]

Doussot et al.

[11] 4,371,877

[45] Feb. 1, 1983

[54] THIN-STRUCTURE AERIAL

[75] Inventors: Michel Doussot, Fontenay Aux Roses; Christian Courtois, Briis sous Forge, both of France

[73] Assignee: U.S. Philips Corporation, New York, N.Y.

[21] Appl. No.: 256,349

[22] Filed: Apr. 22, 1981

[30] Foreign Application Priority Data

Apr. 23, 1980 [FR] France ..... 80 09070

[51] Int. Cl.[3] ..... H01Q 13/10

[52] U.S. Cl. ..... 343/770; 343/846

[58] Field of Search ..... 343/700 MS, 846, 770, 343/854

[56] References Cited

U.S. PATENT DOCUMENTS

| | | | |
|---|---|---|---|
| Re. 29,296 | 7/1977 | Krutsinger et al. | 343/700 MS |
| 2,644,090 | 6/1953 | Dorne | 343/769 |
| 3,653,052 | 3/1972 | Campbell et al. | 343/708 |
| 3,823,404 | 7/1974 | Buie Jr. | 343/708 |
| 3,832,716 | 8/1974 | Plunk et al. | 343/770 |
| 4,110,751 | 8/1978 | Reggia et al. | 343/700 MS |
| 4,238,798 | 12/1980 | Aitken et al. | 343/700 MS |

*Primary Examiner*—David K. Moore

*Attorney, Agent, or Firm*—Robert J. Kraus

[57] ABSTRACT

A thin-structure aerial is formed by means of a sheet of a dielectric substrate 1, whose rear surface is covered with a layer 2 of a conductive material and whose front surface has at least one radiating slot 4 formed in another layer 3 of a conductive material covering said substrate. Means 5are provided for simulating lateral walls surrounding at least one radiating slot. The aerial is characterized in that it is provided with at least one feed slot 10 which is formed in said layer of a conductive material covering the front surface and which is arranged parallel to and in the vicinity of the radiating slot.

7 Claims, 14 Drawing Figures

THIN-STRUCTURE AERIAL

BACKGROUND OF THE INVENTION

The present invention relates to a thin-structure aerial formed by means of a sheet of a dielectric substrate whose rear surface is covered with a layer of a conductive material and whose front surface has at least one radiating slot formed in a further layer of a conductive material on said substrate. Means for simulating lateral walls surrounding at least one radiating slot are also provided.

Aerials of this type are frequently used, for aircraft. Because of their small thickness, such aerials may be deformed for flush-mounting to any aircraft contour, so that the aerodynamic shape of the aircraft is not affected.

U.S. Pat. No. 4,110,751 describes such an aerial. This known aerial has the drawback that the impedance at its feed connector limits the antenna's frequency range to a narrow band.

SUMMARY OF THE INVENTION

The invention proposes an aerial of the type mentioned in the opening paragraph, which has correct matching over a wide band of substantially 10% of the nominal frequency and which provides various radiation patterns in conformity with the requirements of the user.

An aerial in accordance with the invention is characterized in that it is provided with a feed slot which is formed in the layer of conductive material covering the front surface of the substrate and which is disposed in parallel near the radiating slot.

The feed slot has a resonant frequency which, in combination with that of the radiating slot and that of the cavity formed by the front surface, the rear surface and the means for simulating lateral walls, yields and extended frequency range over which suitable matching is obtained.

BRIEF DESCRIPTION OF THE DRAWING

The following description with reference to the accompanying drawing, given by way of non-limitative example, enables the invention to be more fully understood. In the drawing.

DESCRIPTION OF THE PREFERRED EMBODIMENTS

Figure 1:
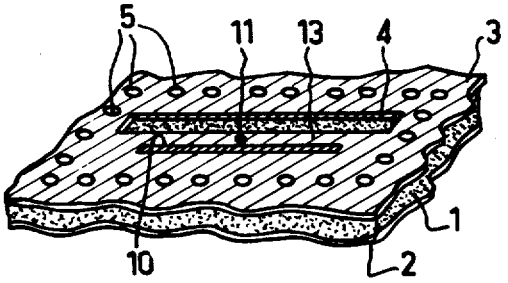
FIG. 1 represents a first aerial in accordance with the invention comprising a radiating slot.

FIG. 1 is a perspective view of an aerial in accordance with the invention. This aerial is formed by means of a sheet 1 of a dielectric substrate. A layer 2 of a conductive material covers the rear surface of said substrate and a further layer 3 covers the front surface. In layer 3 a slot 4 is formed for radiating r.f. power. In accordance with Babinet's principle such a slot will behave as a doublet. The means for simulating the lateral walls are constituted by a series of holes 5. In this way the boundary of the four lateral walls of a parallelepiped cavity is defined, whose fifth wall is constituted by the layer 2 and whose sixth wall is constituted by the layer 3, the radiating slot 4 being parallel to the large side of the rectangle bounded by the holes 5.

Figure 2:
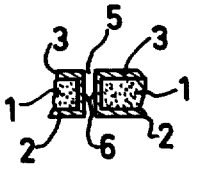
FIG. 2, in detail, represents a hole used for simulating the lateral walls of the aerial.

FIG. 2 shows how said holes are formed. Their interior is covered with a layer 6 of a conductive material, in such a way that the layers 2 and 3 are electrically interconnected. Holes 5 are disposed sufficiently close to each other to behave as a continuous metal wall at the wavelength of the radiation for which the aerial is designed.

In accordance with the invention a thin-structure aerial is characterized in that it is provided with feed slot 10 which is formed in layer 3 of a conductive material covering the front surface and which is disposed in parallel near the radiating slot 4.

The aerial of FIG. 1 is fed in a point 11 disposed in the center of the portion 13 of the conductive material separating the slots 4 and 10. The center point substantially corresponds to the point of intersection of the diagonals of the rectangle defined by the holes 5. It is to be noted that portion 13 constitutes an element of a line of the type known by the name of "coplanar line". Information concerning this type of line can be found in the following publication:

MICROWAVE TRANSMISSION LINE IMPEDANCE DATA by M. A. R. GUNSTON, VAN NOSTRAND Reinhold Cy LONDON.

Hereinafter this type of line will be referred to as: "coplanar line".

Figure 3:
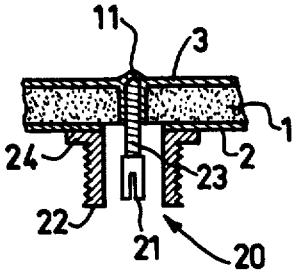
FIG. 3, in detail, represents the feed arrangement of the aerial.

FIG. 3 shows an example of how the feed point 11 is connected by means of a coaxial receptacle 20 constituted by a pin 21 surrounded by a metal part 22 formed with an external screw-thread, enabling a standard coaxial plug to be fitted. A pin 23 in line with the pin contact 21 enables the latter to be connected to point 11 on the layer 3. The portion 22 changes into a flange 24 to be connected to the layer 2.

Figure 4:
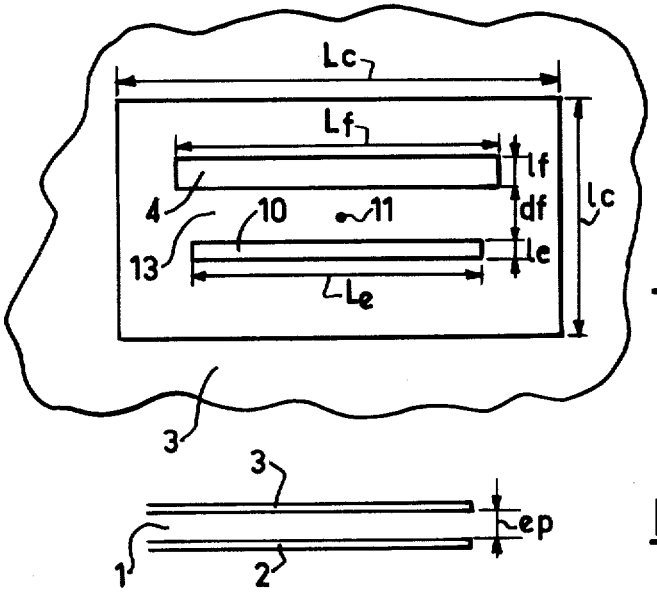
FIG. 4 is a diagram showing the various dimensions of the aerial shown in FIG. 1.

In FIG. 4 the various quantities are indicated which are of importance for the design of an aerial in accordance with the invention. These quantities depend on the nominal operating frequency Fo.

Lc: is the length of the cavity and "lc" its width. For reasons of simplicity the boundaries of the cavity are represented by solid lines.

"ep" is the thickness of the cavity, that is the thickness of the substrate 1.

Lf and "lf" are the length and the width, respectively, of the radiating slot 4.

Le and "le" are the length and width of the feed slot 10.

$\epsilon r$ is the dielectric constant of the substrate 1.

"df" is the distance between the slots 10 and 4.

The point 11 in the center of the portion 13 is disposed at the intersection of the diagonals (not shown) of the rectangle Lc×lc.

The frequency Fo corresponds to a wavelength λo:

$$\lambda o = c/Fo, \tag{1}$$

where c is the velocity of light.

When a waveguide is considered which is filled with a dielectric whose dielectric constant is $\epsilon r$ and whose transverse dimensions are "lc" and "ep", the wavelength of the guided wave (λg) in the fundamental mode is:

$$\lambda g = \frac{\lambda o}{\sqrt{\epsilon r - (\lambda o/2(1c)^2}} \tag{2}$$

The requirement for resonance of the cavity is:

$$Lc = k_1(\lambda g/2) \tag{3}$$

On the other hand, the elementary aerial corresponds to a resonant slot of the length $k_2(\lambda o/2)$, which implies:

$$Lc \simeq k_2(\lambda o/2) \tag{4}$$

$k_1$ and $k_2$ being positive integers.

With the aid of equation (2) it is found that for the fundamental mode $k_1 = k_2 = 1$.

$$1c = \frac{\lambda o/2}{\sqrt{\epsilon r - 1}} \tag{5}$$

The resonant frequency is related to the cavity parameters by the equation:

$$Fo = c\frac{\sqrt{1 + (Lc/1c)^2}}{2\,Lc\sqrt{\epsilon r}} \tag{6}$$

On the other hand, the portion 13, as already stated, constitutes a coplanar line. With this type of line the impedance calculations and the calculations of the velocity propagation should allow for a fictitious dielectric constant $\epsilon f$, whose value is:

$$\epsilon f = (\epsilon r + 1)/2 \tag{7}$$

Thus, the resonant frequency $F_1$ of the coplanar line portion is equal to:

$$F_1 = (c/Le)\sqrt{\frac{2}{\epsilon r + 1}} \tag{8}$$

Finally, the resonant frequency $F_2$ of the radiating slot 4 is:

$$F_2 = c/(2Lf). \tag{9}$$

Thus, it will be evident that the aerial in accordance with the invention has three resonant frequencies.

the first one is that of the parallelepiped cavity; the value of this first frequency is given by formula (6);

the second one is that of the coplanar line; it is given by formula (8);

the third one is that of the radiating slot 4 and it is in conformity with formula (9).

The other parameters which do not occur in the above formulas inter alia define the coupling coefficients of these different resonators. By varying all the parameters, it is possible to obtain a comparatively wide frequency band over which satisfactory matching is obtained.

The Applicant has found that for an aerial whose parameters have the following values:

Lc=36 mm
lc=18.5 mm
Lf=35 mm
Le=21 mm
le=0.15 mm
df=2 mm
ep=3 mm
$\epsilon r$=4.5 mm (epoxy-glass)

a standing-wave ratio smaller than or equal to 2 is obtained for a frequency from 4.1 GHz to 4.5 GHz.

Figure 5:
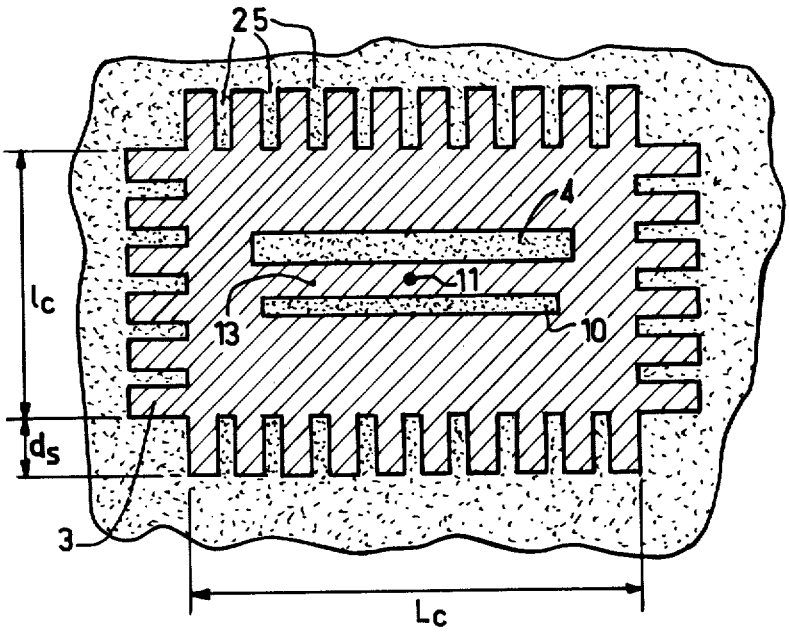
FIG. 5 shows a second embodiment of an aerial in accordance with the invention, employing crenellations for simulating the lateral walls.

Starting from the basic structure of the above-described aerial, it is possible to realize several variations within the scope of the invention. Thus, the means for simulating the lateral walls may be realized in a manner other than that indicated for the aerial of FIG. 1. It is evident that said means may be constituted by conductive plates, but advantageous means are used for the aerial of FIG. 5. While the remainder of the aerial is identical to that of FIG. 1, in order to define the lateral walls of the aerial of FIG. 5, there are provided crenellations 25 situated between the solid portions 26 which form part of the metal layer 3 deposited on the front surface of the aerial. The overall dimensions of the plate are then: (Lc+ds)×(lc+ds) where "ds" is the depth of the crenellation.

Figure 6:
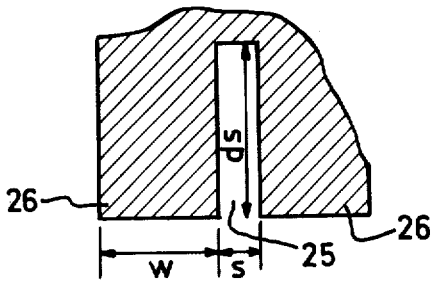
FIG. 6 represents a crenellation in detail.

Said crenellations and solid portions form microstrip lines. By a suitable choice of the value "ds" an impedance of substantially zero is obtained at the bottom of the crenellations. Said impedance will further approximate to zero as the width w of the solid portion (see FIG. 6) becomes greater relative to the thickness "ep" of the dielectric substrate. For this subject reference is made to the publication by GUNSTON sections 3.6 and 6.3. With respect to determining the value "ds" this value should be such that:

$$ds = \lambda_\mu/4$$

$\lambda_\mu$ being the wavelength guided by the microstrip lines.

Figure 7:
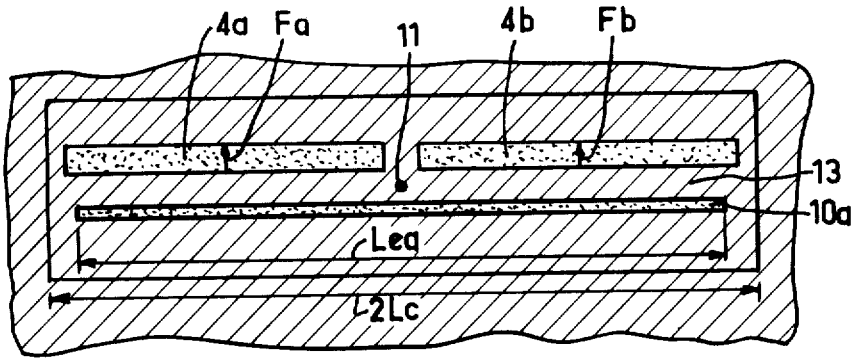
FIG. 7 represents a third embodiment of an aerial in accordance with the invention, comprising two radiating slots which are fed in phase.

FIG. 7 shows another aerial in accordance with the invention. This aerial comprises two radiating slots 4a and 4b arranged in line with each other and a rectilinear feed slot 10*a* disposed parallel to the slots 4*a* and 4*b*; the feed point 11 is disposed in the center of the portion 13 of the layer of a conductive material, which separates the slots 4*a* and 4*b* from the slot 10*a*. The cavity which is bounded by solid lines in said Figure has the dimensions "lc", 2Lc and a depth: "ep". This means that a cavity is obtained which is two times as long as that of the aerial of FIG. 1. The slots 4*a* and 4*b* have the same length as the slot 4. The slot 10*a* has a length "Lea" whose order of magnitude is $2\times Lf$.

In this embodiment the slots 4*a* and 4*b* are fed in phase, which is schematically represented by the arrows Fa and Fb, which point upwards in the Figure. In this case the maximum radiation is obtained in a direction perpendicular to the front surface of the aerial.

Figure 8:
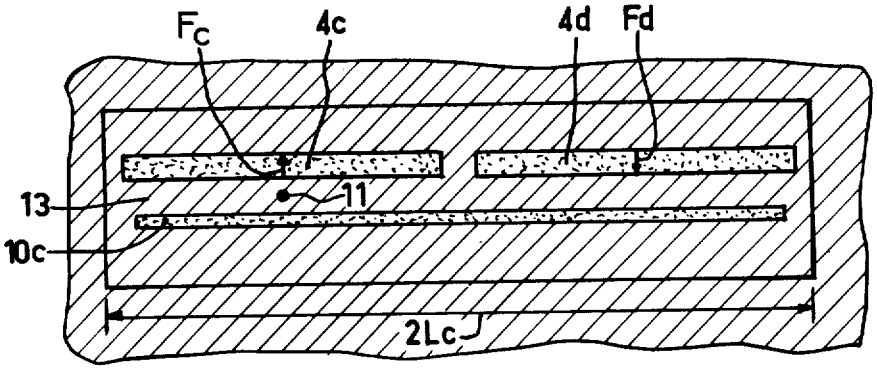
FIG. 8 represents a fourth embodiment of an aerial in accordance with the invention, comprising two radiating slots fed in phase opposition.

The aerial shown in FIG. 8 has a radiation pattern which differs from that of the aerial of FIG. 7. Although the aerial of FIG. 8 has slots 4*c*, 4*d* and 10*c* which are arranged and dimensioned identically to those of FIG. 7, the radiating slots are energized in phase opposition, which is indicated by the arrow Fc relating to the slot 4*c* and pointing upwards in the Figure and by the arrow Fd relating to the slot 4*d* and pointing downwards. This energization in phase opposition is obtained by the special arrangement of the feed point 11, which is disposed in the center of the portion 13 between the slot 4*c* and the slot 10*c*. This arrangement promotes an asymmetrical distribution of the electric field inside the cavity. The cavity is then excited in the $H_{1,0,2}$ mode and the radiation pattern of the aerial of FIG. 8 will exhibit a radiation minimum in the direction in which the aerial of FIG. 7 exhibits a maximum.

Figure 9:
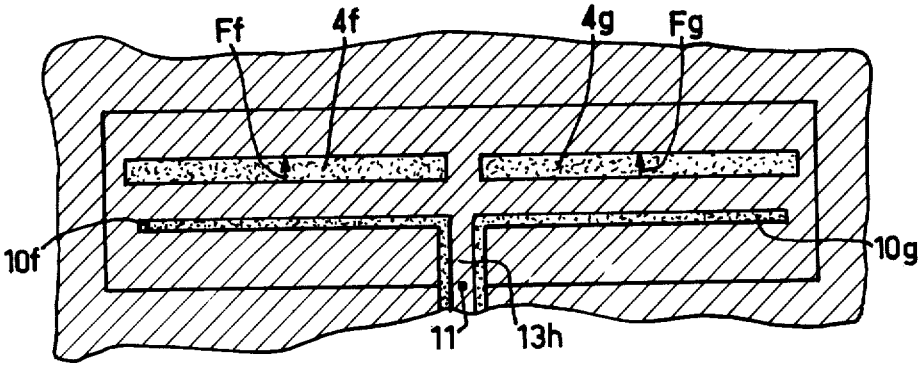
FIG. 9 represents a fifth embodiment of an aerial in accordance with the invention, which is similar to the third embodiment, comprising two radiating slots which are fed in phase, but whose feed point is shifted.

FIG. 9 shows another embodiment of an aerial in accordance with the invention. This aerial has two radiation slots 4*f* and 4*g* associated with feed slots 10*f* and 10*g*, respectively. The feed point 11 is disposed on a coplanar line formed by a conductive portion 13*h* disposed perpendicularly to the aligned slots 4*f* and 4*g* and bounded by the two feed slots 10*f* and 10*g*. The radiating slots 4*f* and 4*g* are thus excited in phase, which is indicated by the arrows Ff and Fg, which point upwards in the Figure. The radiation pattern is therefore identical to that of the aerial of FIG. 7.

Figure 10:
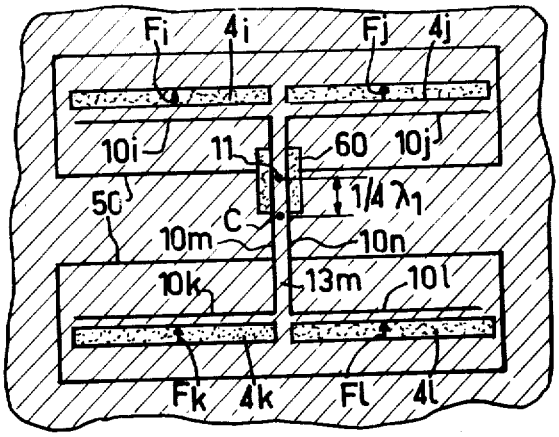
FIG. 10 represents a sixth embodiment of an aerial in accordance with the invention, comprising four radiating slots which are fed in phase.

FIG. 10 represents a preferred embodiment of an aerial in accordance with the invention. This aerial comprises four radiating slots 4*i*, 4*j*, 4*k* and 4*l*; the slots 4*i* and 4*j*, which are arranged in line with each other, are surrounded by lateral walls or equivalent means (holes or crenellations) arranged in accordance with a rectangle. The slots 4*k* and 4*l*, which are also arranged in line with each other, are surrounded in a similar manner. The slots 4*k* and 4*l* are arranged underneath the slots 4*i* and 4*j*. Associated with said four slots are four feed slots 10*a*, 10*j*, 10*k*, and 10*l*, which are disposed parallel to their respective radiating slots. The slots 10*i* and 10*k* are connected by a slot 10*m*, which is perpendicular thereto and the slots 10*j* and 10*l* are similarly interconnected by a slot 10*n*. The feed point 11 is shifted relative to the center C of a conductive portion 13*m* situated between the slots 10*m* and 10*n*. The off-centre distance is chosen to equal $\frac{1}{4}\lambda_l$, $\lambda_l$ being the wavelength guided in the coplanar line, so that a phase lead of 180° is introduced between the energizing voltages of the slots 10*i* and 10*j* on the one hand and those of the slots 10*k* and 10*l* on the other hand. When allowance is made for the geometry of the coplanar lines, this results in an in-phase energization of the four radiating slots 4*i*, 4*j*, 4*k* and 4*l*, which is indicated by the arrows Fi, Fj, Fk and Fl in the respective slots 4*i*, 4*j*, 4*k* and 4*l*, which arrows all point upwards in the Figure. Thus, a radiation pattern is obtained having a maximum in a direction perpendicular to the front surface in the Figure. In order to obtain suitable matching, there is provided a quarter-wave transformer 60. Said transformer is constituted by a widening of the slots 10*m* and 10*n* over a length which is equal to a quarter of the wavelength propagated over the coplanar line and measured from the feed point 11. This widening is such that said coplanar line section then has a characteristic impedance equal to the geometric means of the impedance to be matched and the desired impedance on point 11. Although the use of a quarter-wave line for matching is well-known in the art, it is to be noted that its use is particularly suitable for the aerial of FIG. 10, because no additional material is required.

Figure 11:
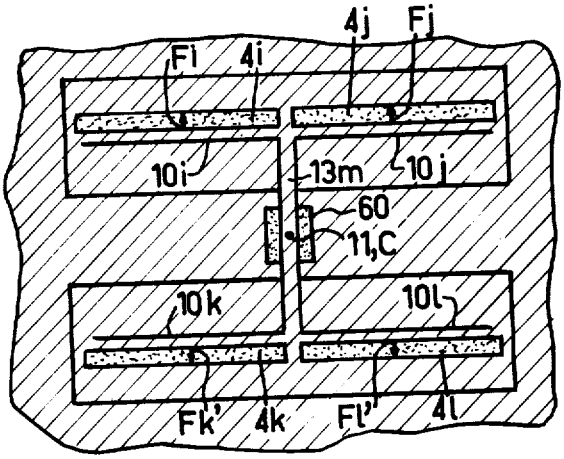
FIG. 11 represents a seventh embodiment of an aerial in accordance with the invention, comprising four radiating slots, two of which are fed in phase opposition.

The aerial shown in FIG. 11 is constructed in the same way as that of FIG. 10, except that the feed point 11 is disposed in the center of symmetry C of the aerial. Thus, an anti-phase feed is obtained between the slots 4*i* and 4*j*, and the slots 4*k* and 4*l*. The arrows Fk' and Fl' consequently have a direction which differs from that of the arrows Fk and Fl of FIG. 10. This results in a radiation pattern which cancels itself in the plane of symmetry perpendicular to the electric field whose direction is indicated by the arrows Fi, Fj, Fh', Fl'. On both sides of said plane the value of the radiated field changes sign.

Figure 12:
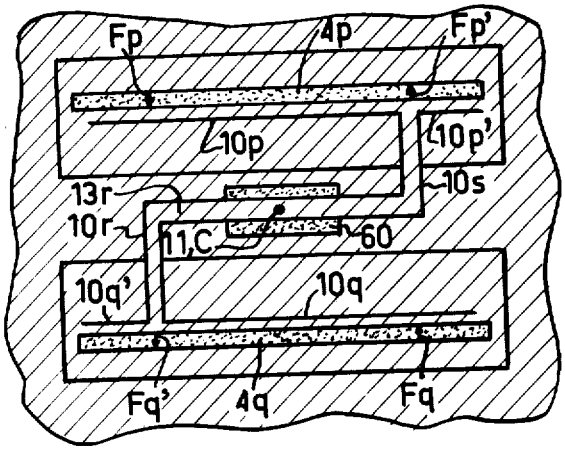
FIG. 12 represents of an eighth embodiment of an aerial in accordance with the invention, comprising two double-length radiation slots fed in phase opposition.
Figure 13:
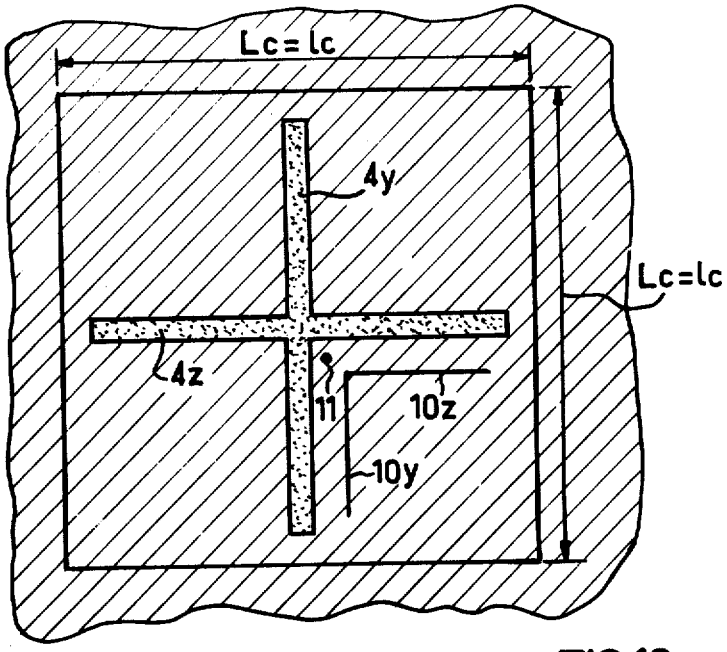
FIG. 13 represents a ninth embodiment of an aerial in accordance with the invention, comprising two slots disposed perpendicularly to each other.

The aerial of FIG. 12 has two slots 4*p* and 4*q* disposed parallel to each other. Said slots have a length which is two times that of the preceding one, in such a way that the first half of the aerial radiates in phase opposition with respect to the second half. For the slot 4*p* this is indicated by the arrows Fp and Fp', which are directed oppositely, and for the slot 4*q* by the arrows Fq and fq', which are also directed oppositely. Moreover, the arrows Fp and F1 have opposite directions. Associated with the slot 4*p* is a parallel feed slot formed by two portions 10*p* and 10*p'* and with the slot 4*q* feed slot formed by the portions 10*q* and 10*q'*. The slots 10*p* and 10*q'* are interconnected by slot 10*r* in the form of a staircase. Said slot joins the slots 10*p* and 10*q'* at right angles. In a similar way the slots 10*p'* and 10*q* are interconnected by a slot 10*f*, which is arranged parallel to the slot 10*r*. The conductive portion 13*r* situated between the two slots 10*r* and 10*s* comprises a portion parallel to the feed slots 10*p* and 10*q*, the feed point 11 being disposed in the center of said portion, which in this case coincides with the centre of symmetry C of the aerial. In this case there is also provided a quarter-wave transformer 60. The radiation pattern cancels itself in the plane of symmetry which passes through point C and which is parallel to the directions given by the arrows Fp, Fp', Fq, Fq'. The sign of the radiated field changes on both sides of said plane. With respect to polarity the aerial of FIG. 12 is the complementary of that of FIG. 8. FIG. 13 shows an interesting aerial in accordance with the invention. Here, use is made of a dielectric substrate whose dielectric constant is chosen so that $Lc=lc=\lambda o/2$, allowance being made for the aerial dimensions.

Thus, radiating slots can be obtained in two orthogonal directions, that is the slots 4*y* and 4*z*. In order to excite said slots two feed slots 10*y* and 10*z* are disposed parallel to the radiating slots. These slots are interconnected arranging the feed point 11 near said interconnection and by selecting different lengths for said slots in such a way that the energization of the slots 4y and 4z is in phase quadrature, a circularly polarized radiation field is obtained.

Figure 14:
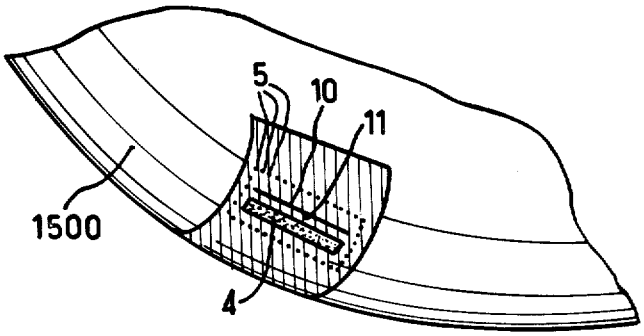
FIG. 14 represents an aerial in accordance with the invention, which is flush-mounted to an arbitrary contour.

FIG. 14 by way of example represents the manner in which an aerial in accordance with the invention, for example the aerial of FIG. 1, can be flush-mounted to the curved contour 150 of an aircraft.

What is claimed is:

1. An aerial comprising a sheet of dielectric having front and rear surfaces each covered with a layer of conductive material, the conductive layer on the front surface including:

(a) at least one radiating slot;

(b) at least one feed slot parallel to a radiating slot;

(c) a conductive portion bounded by at least two of the slots in the layer;

(d) a feed point in said conductive portion; and (e) means for defining sidewalls of a cavity which is disposed between said layers of conductive material, said side walls surrounding at least one radiating slot and said parallel feed slot.

2. An aerial as in claim 1, characterized in that said means for defining sidewalls comprise conductive elements which interconnect the layers of conductive material covering the front and rear surfaces.

3. An aerial as in claim 1, characterized in that said means for defining sidewalls comprises holes through the dielectric sheet having their sides covered by layers of a conductive material bringing the layer covering the front surface into contact with the layer covering the rear surface.

4. An aerial as in claim 1, characterized in that said means for defining sidewalls comprises crenellations in the conductive layer covering the front surface, the depth of the crenellations being such that an impedance of substantially zero is obtained at the bottom of said crenellations.

5. An aerial as in claim 1, 2, 3 or 4, characterized in that the feed point in the conductive portion is disposed between a radiating slot and a feed slot.

6. An aerial as in claim 1, 2, 3 or 4 including a coaxial connector comprising a contact pin electrically-connected to the feed point and a flange electrically-connected to the layer of conductive material covering the rear surface of the dielectric sheet.

7. An aerial as in claim 1, 2, 3 or 4 adapted to radiate a circularly polarized wave, characterized in that it comprises two radiating slots disposed perpendicularly to each other and in that the lengths of feed slots parallel to said radiating slots are selected so as to obtain phase-quadrature energization of the radiating slots.

* * * * *